US006194824B1

(12) United States Patent
Ueda

(10) Patent No.: US 6,194,824 B1
(45) Date of Patent: Feb. 27, 2001

(54) COLOR CATHODE RAY TUBE WITH ASTIGMATISM CORRECTION SYSTEM

(75) Inventor: Yasuyuki Ueda, Osaka (JP)

(73) Assignee: Matsushita Electronics Corporation, Osaka (JP)

( * ) Notice: Subject to any disclaimer, the term of this patent is extended or adjusted under 35 U.S.C. 154(b) by 0 days.

(21) Appl. No.: 09/116,357

(22) Filed: Jul. 16, 1998

(30) Foreign Application Priority Data

Aug. 4, 1997 (JP) ..... 9-208845

(51) Int. Cl.[7] ..... H01J 29/76
(52) U.S. Cl. ..... 313/413; 313/431; 313/440
(58) Field of Search ..... 313/412, 413, 313/414, 440, 442, 431

(56) References Cited

U.S. PATENT DOCUMENTS

| | | | | |
|---|---|---|---|---|
| 4,415,831 | * | 11/1983 | Konosu | 313/413 |
| 4,742,279 | | 5/1988 | Gerritsen et al. | 315/382 |
| 4,797,593 | | 1/1989 | Saito et al. | 313/346 R |
| 4,814,670 | | 3/1989 | Suzuki et al. | 313/414 |
| 4,833,364 | | 5/1989 | Izumida et al. | 313/414 |
| 4,876,478 | * | 10/1989 | Morohashi et al. | 313/413 |
| 4,886,999 | | 12/1989 | Yamane et al. | 313/414 |
| 4,945,283 | | 7/1990 | Van Der Heijden et al. | 313/450 |
| 4,945,284 | | 7/1990 | Shimona et al. | 313/414 |
| 5,519,290 | | 5/1996 | Sugawara et al. | 315/382.1 |
| 5,675,211 | | 10/1997 | Ueda | 313/412 |
| 5,773,925 | | 6/1998 | Kimura et al. | 313/414 |
| 5,818,157 | | 10/1998 | Stil et al. | 313/414 |
| 5,831,399 | | 11/1998 | Ohta et al. | 315/382.1 |
| 5,905,332 | | 5/1999 | Yun et al. | 313/414 |
| 5,942,847 | | 8/1999 | Roth | 313/456 |

FOREIGN PATENT DOCUMENTS

| | | | |
|---|---|---|---|
| 0 646 944 A2 | 4/1995 | (EP) | H01J/29/50 |
| 55-21832 | 2/1980 | (JP) | H01J/29/50 |
| 55-141051 | 11/1980 | (JP) | H01J/29/50 |
| 59-111237 | 6/1984 | (JP) | H01J/29/50 |
| 61-99249 | 5/1986 | (JP) | H01J/29/50 |
| 1-232643 | 9/1989 | (JP) | H01J/29/50 |
| 2-106855 | 4/1990 | (JP) | H01J/29/50 |
| 3-93135 | 4/1991 | (JP) | H01J/29/50 |
| 3-95835 | 4/1991 | (JP) | H01J/29/50 |
| 3-233839 | 10/1991 | (JP) | H01J/29/50 |
| 3-283236 | 12/1991 | (JP) | H01J/29/50 |
| 7-6707 | 1/1995 | (JP) | H01J/29/50 |
| 7-6709 | 1/1995 | (JP) | H01J/29/50 |
| 7-226170 | 8/1995 | (JP) | H01J/29/50 |
| 8-22779 | 1/1996 | (JP) | H01J/29/50 |

* cited by examiner

*Primary Examiner*—Michael H. Day
(74) *Attorney, Agent, or Firm*—Merchant & Gould P.C

(57) ABSTRACT

Four magnetic pieces are provided inside the cup-shaped portion of a shield cup. Correction magnetic field generating faces at the tips of the magnetic pieces are opposed to each other and sandwich an electron beam. Correction can be conducted according to the astigmatism amount of three electron beams because a correction magnetic field corresponding to the strength of a deflection magnetic field can be generated easily by leading the deflection magnetic field absorbed by the principal face portion of each magnetic piece to the correction magnetic field generating face. Thus, the difference in astigmatism amount among the electron beams caused by the deflection magnetic field can be corrected. Therefore, a color cathode ray tube apparatus that can display images with a high resolution over the whole screen surface can be provided.

4 Claims, 8 Drawing Sheets

COLOR CATHODE RAY TUBE WITH ASTIGMATISM CORRECTION SYSTEM

FIELD OF THE INVENTION

The present invention relates to a color cathode ray tube apparatus for a television or a computer display monitor, and more particularly to a color cathode ray tube apparatus that is configured to obtain a high resolution over the whole phosphor screen.

BACKGROUND OF THE INVENTION

In a self-convergence type color cathode ray tube comprising an in-line type electron gun for aligning three electron beams and a deflection yoke for generating a horizontal deflection magnetic field distorted in a pincushion shape and a vertical deflection magnetic field distorted in a barrel shape, the distortion of the deflection magnetic fields for self-convergence causes a quadrupole astigmatism of the electron beams.

As a technology for correcting the astigmatism, Japanese Patent Application (Tokkai Sho) No. 61-99249 describes correcting the cross-sectional shape of the electron beams by producing a nonaxisymmetric lens between a first focusing electrode and a second focusing electrode according to the deflection degree.

FIG. 7 shows the electron gun of a color cathode ray tube apparatus according to this prior art. Vertically long electron beam openings 18 are provided on the face of a first focusing electrode 14 at the side facing a second focusing electrode 15. Horizontally long electron beam openings 19 are provided on the face of the second focusing electrode 15 at the side facing the first focusing electrode 14. A constant focusing voltage Vfoc is applied to the first focusing electrode 14. A dynamic focusing voltage that gradually increases from the focusing voltage Vfoc with the increase of the deflection amount is applied to the second focusing electrode 15. This technology can obtain a dynamic focusing action in response to a change in the electron beam focusing amount caused by a difference in the distance between the electrode gun and the phosphor screen when the electron beams are deflected and an action for correcting the astigmatism of the electron beams caused by the deflection magnetic field simultaneously.

However, the above prior art can only correct the same amount of astigmatism of the three electron beams simultaneously.

The actual astigmatism amounts of the right and left electron beams are different from each other. Furthermore, the difference in the astigmatism amount is opposite depending on the deflection derection.

FIG. 8 shows the size of forces acting on three electron beams emitted from an in-line type electron gun in the deflection magnetic field generated by a self-convergence type deflection yoke. As can be seen from FIG. 8, a force that distorts the cross-sectional shape of the electron beams to be horizontally long acts most strongly on the right electron beam (R beam) when the electron beams are deflected to the right side of the screen. The larger the deflection degree is, the stronger the force is. On the other hand, the force that distorts the cross-sectional shape of the electron beams to be horizontally long acts most strongly on the left electron beam (B beam) when the electron beams are deflected to the left side of the screen.

The difference in the astigmatism amount among the electron beams is significant especially in a color cathode ray tube having a large deflection angle and a short total length and a color cathode ray tube having a substantially flat phosphor screen, and prevents implementing a high resolution over the whole phosphor screen.

SUMMARY OF THE INVENTION

It is an object of the present invention to provide a color cathode ray tube apparatus that can implement a high resolution over the whole phosphor screen of a color cathode ray tube having a large deflection angle and a short total length or a color cathode ray tube having a substantially flat phosphor screen.

In order to accomplish the above object, the present invention provides a color cathode ray tube apparatus comprising a color cathode ray tube comprising an in-line type electron gun for emitting three electron beams and a self-convergence type deflection yoke, wherein the electron gun comprises a correction system for correcting a difference in astigmatism amount among the three electron beams emitted from the electron gun. According to the color cathode ray tube apparatus of the present invention, the difference in astigmatism amount among the electron beams can be corrected. Thus, a high resolution can be obtained over the whole phosphor screen of a color cathode ray tube having a large deflection angle and a short total length or a color cathode ray tube having a substantially flat phosphor screen.

It is preferable that the correction system causes a correction magnetic field to act on at least one outer electron beam of the three electron beams by using a deflection magnetic field generated by the deflection yoke or a magnetic field whose strength varies in synchronization with the deflection magnetic field, thereby changing the cross-sectional shape of the at least one outer electron beam. According to this preferable example, the difference in astigmatism amount among the electron beams can be eliminated by the correction magnetic field having a strength corresponding to the astigmatism amount by using the deflection magnetic field or the magnetic field in synchronism with the deflection magnetic field.

It is preferable that the correction system comprises magnetic pieces comprising a principal face portion for absorbing an external magnetic field, an arm for guiding the external magnetic field absorbed by the principal face portion near the electron beam, and a correction magnetic field generating face provided at the tip of the arm and facing the electron beam, the magnetic pieces being positioned so that the correction magnetic field generating faces sandwich at least one outer electron beam of the three electron beams. According to this preferable example, the correction system can be located easily and reliably, and the correction magnetic field acts on the electron beam efficiently.

It is preferable that the in-line type electron gun further comprises a second correction system for correcting the astigmatism of the three electron beams simultaneously. According to this preferable example, the astigmatism of the three electron beams can be corrected most preferably.

DETAILED DESCRIPTION OF THE INVENTION

Preferred embodiments of the present invention will be described below with reference to the drawings.

First Embodiment

Figure 2:
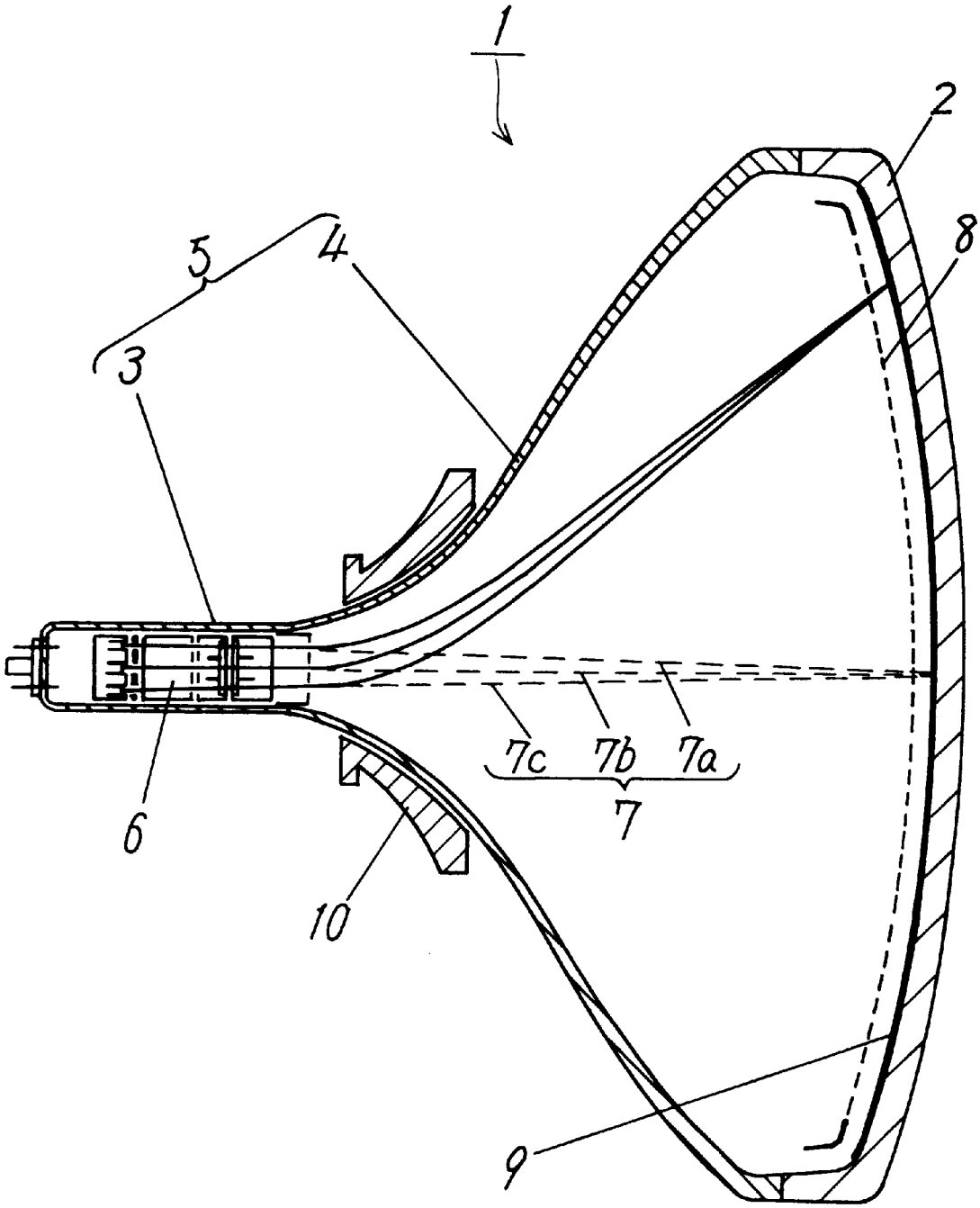
FIG. 2 is a cross-sectional top view of the color cathode ray tube apparatus according to the first embodiment.

FIG. 2 is a cross-sectional top view of a color cathode ray tube apparatus according to a first embodiment of the present invention.

In the color cathode ray tube 1 of the color cathode ray tube apparatus according to the first embodiment, a glass panel 2 and a funnel 5 comprising a neck portion 3 and a cone portion 4 are sealed with a fritted glass (not shown) and form an envelope. Three electron beams 7*a*, 7*b* and 7*c* are emitted from an electron gun 6 provided inside the neck portion 3 and pass through the openings of a shadow mask 8 that serves as a color-selecting electrode to reproduce color images on a phosphor screen 9. A deflection yoke 10 for deflecting the electron beams is attached on the outside of the neck portion of the color cathode ray tube 1. Thus, a color cathode ray tube apparatus is formed.

The electron gun 6 is an in-line type electron gun in which the three electron beams 7*a*, 7*b* and 7*c* are aligned in the horizontal direction of the phosphor screen 9. The deflection yoke 10 is a self-convergence type deflection yoke. It generates a horizontal deflection magnetic field distorted in a pincushion shape and a vertical deflection magnetic field distorted in a barrel shape so that the electron beams 7*a*, 7*b* and 7*c* converge substantially at one point in each region of the phosphor screen 9 due to the distortion of these magnetic fields.

In the color cathode ray tube according to this embodiment, the electron beams are arranged in line in the order of red (7*a*), green (7*b*), and blue (7*c*) from the right as seen from the phosphor screen side.

Figure 3:
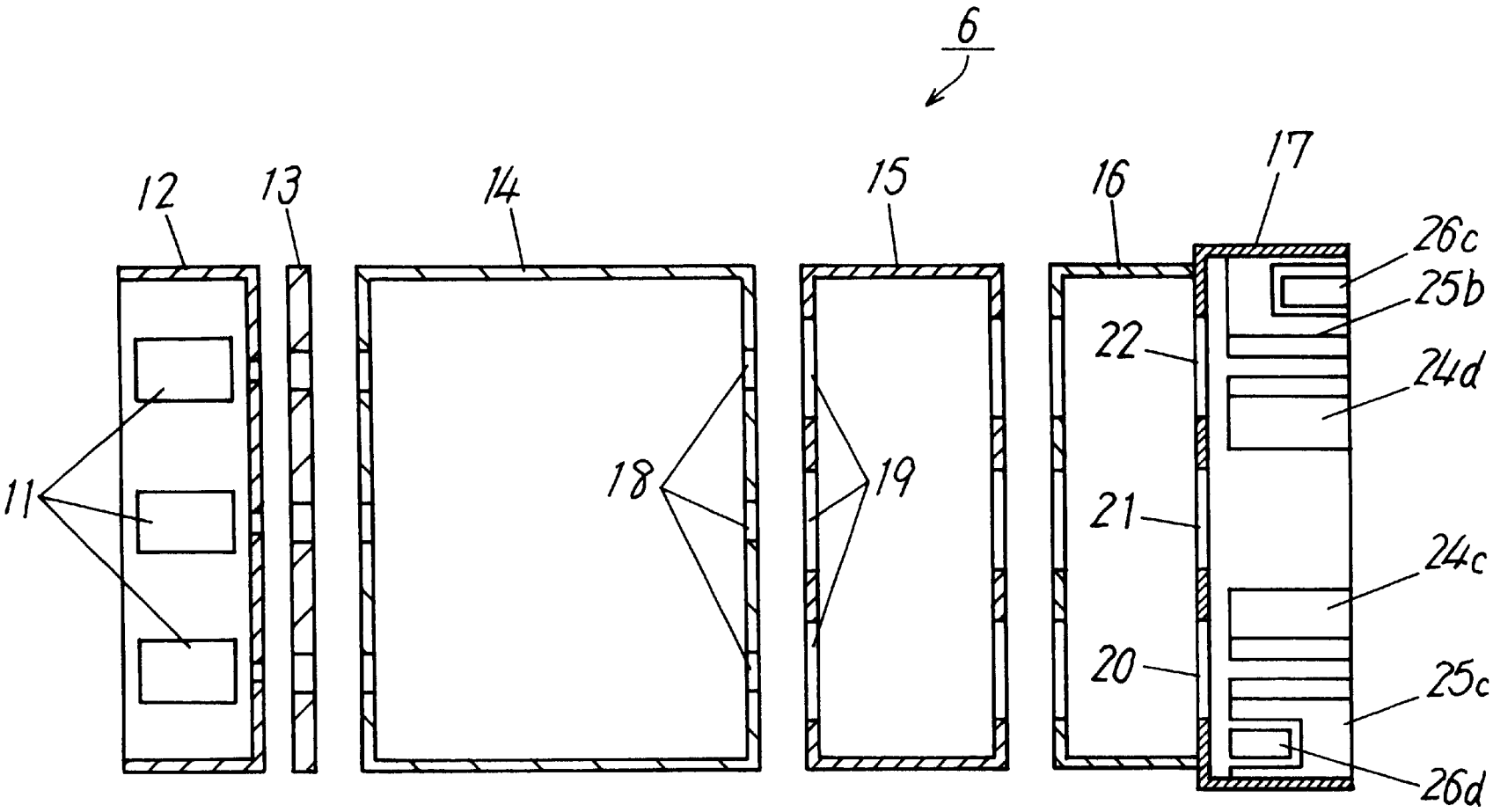
FIG. 3 is a cross-sectional view of the electron gun of the color cathode ray tube apparatus according to the first embodiment.
Figure 7:
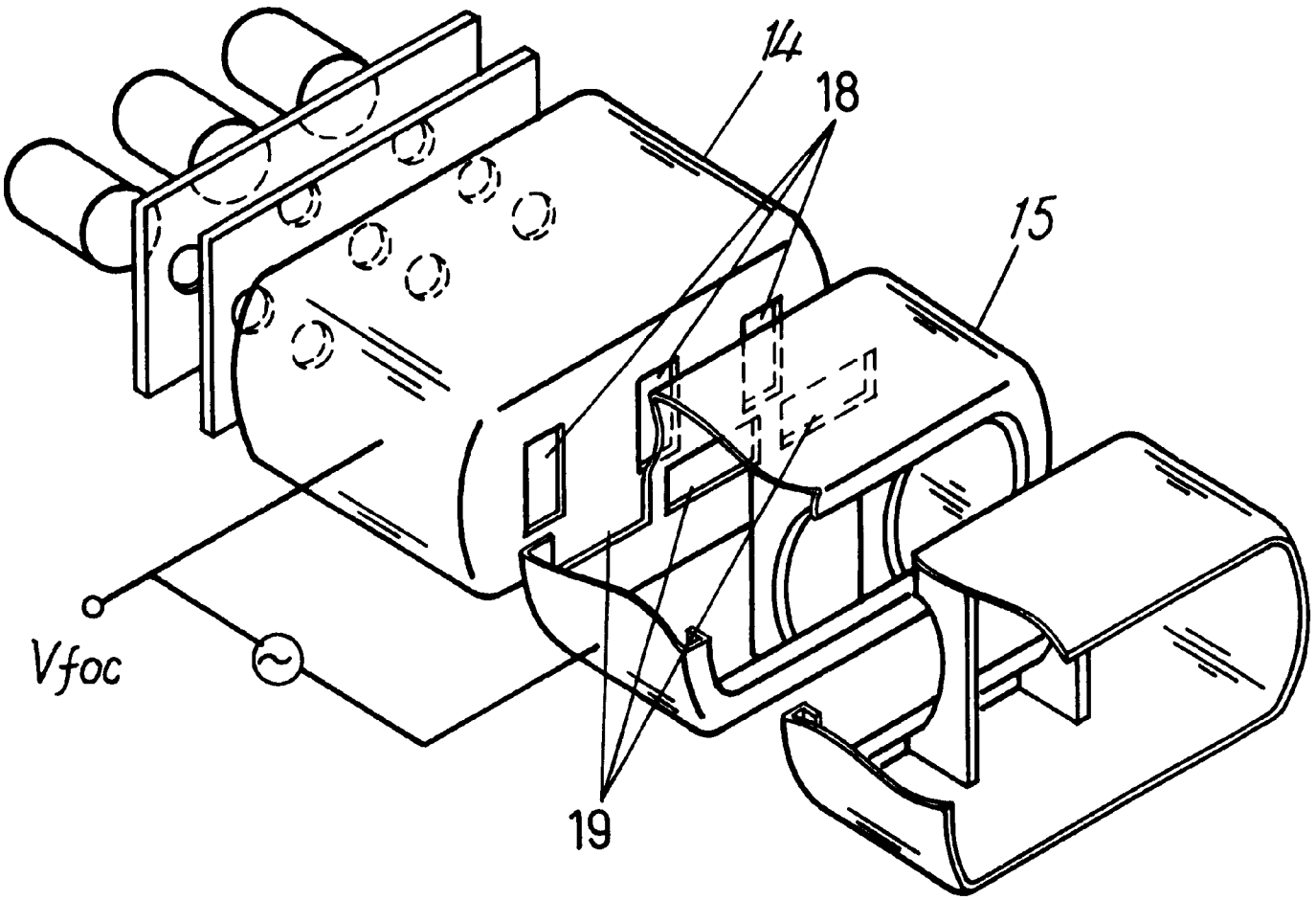
FIG. 7 PRIOR ART
FIG. 7 is a perspective view of the electron gun of a conventional color cathode ray tube apparatus.

FIG. 3 is a transverse cross-sectional view of the electron gun of the color cathode ray tube apparatus according to the first embodiment of the present invention. In FIG. 3, like reference numerals denote like parts as shown in FIG. 7, which illustrates the electron gun of a conventional color cathode ray tube apparatus.

The electron gun 6 of the color cathode ray tube apparatus according to this embodiment comprises three cathodes 11 aligned horizontally, a control electrode 12, an accelerating electrode 13, a first focusing electrode 14, a second focusing electrode 15, and an anode 16, which are located in this order from the cathodes 11 to the phosphor screen side. The electron gun 6 accelerates and focuses electron beams. A shield cup 17 having a circular cross-section is provided on the phosphor screen side of the anode electrode 16. The shield cup 17 aligns the central axes of the electron gun and the neck portion of the color cathode ray tube by a centering spring (not shown) when the electron gun is inserted into the neck portion.

In this embodiment, as in the conventional color cathode ray tube apparatus, vertically long electron beam openings 18 are provided on the face of the first focusing electrode 14 at the side facing the second focusing electrode 15. Horizontally long electron beam openings 19 are provided on the face of the second focusing electrode 15 at the side facing the first focusing electrode 14. A constant focusing voltage Vfoc is applied to the first focusing electrode 14. A dynamic focusing voltage that gradually increases from the focusing voltage Vfoc with the increase of deflection amount is applied to the second focusing electrode 15.

The feature of the electron gun 6 of the color cathode ray tube apparatus according to this embodiment is that it comprises four magnetic pieces 23, 24, 25 and 26 in the shield cup 17 for correcting the quadrupole astigmatism of the outer electron beams.

Figure 1:
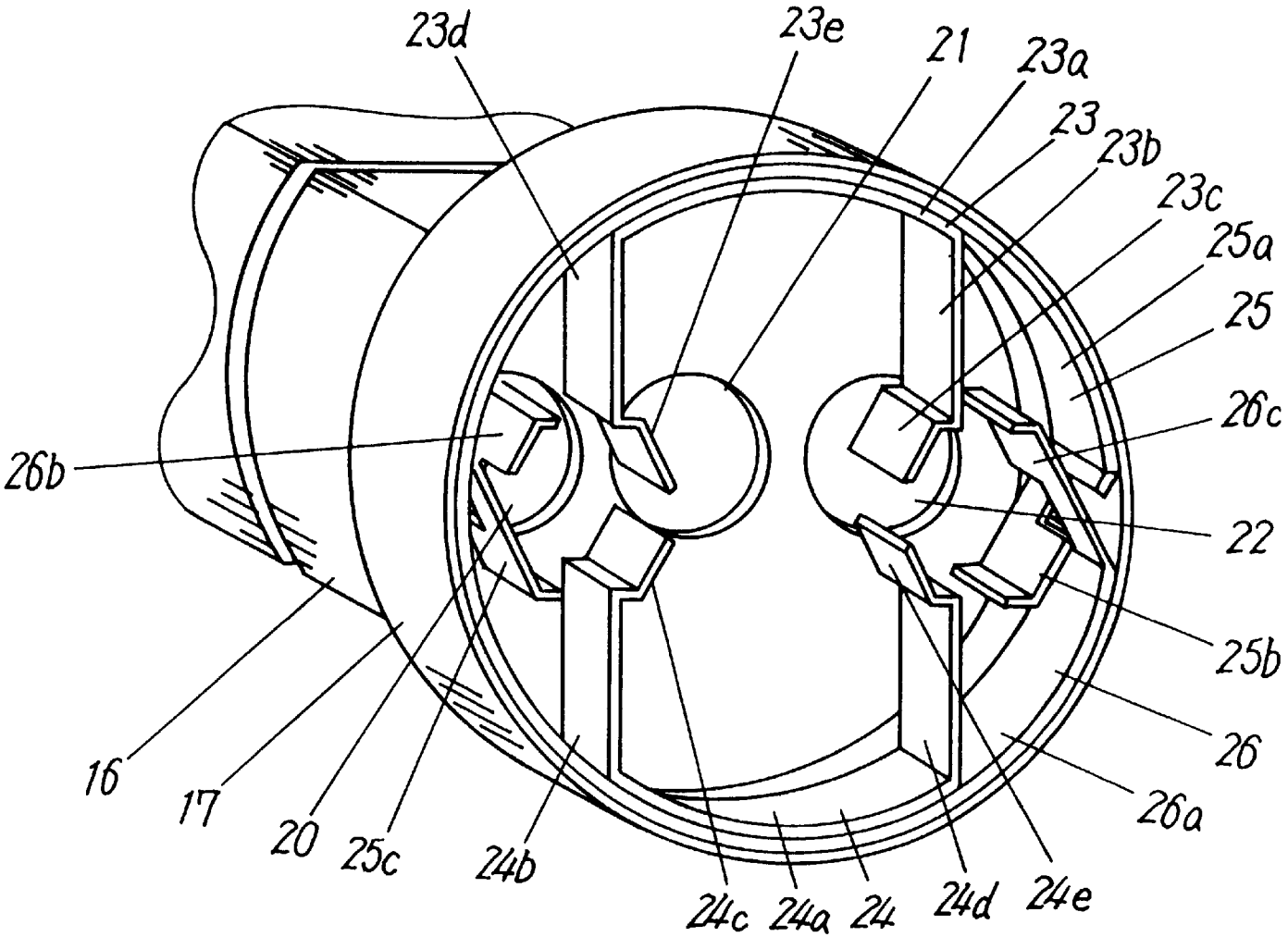
FIG. 1 is a perspective view of the shield cup of a color cathode ray tube apparatus according to a first embodiment of the present invention.

FIG. 1 is a perspective view of the shield cup 17 of the color cathode ray tube apparatus according to this embodiment.

As shown in FIG. 1, four magnetic pieces 23, 24, 25 and 26 are provided inside the cup-shaped portion of the shield cup 17. These magnetic pieces are made by folding a magnetic ribbon of $\mu$-metal (FeNi alloy) or the like having a thickness of 0.25 mm and a width of 5.0 mm.

The material of the magnetic pieces as a correction system is not limited to $\mu$-metal (FeNi alloy). Fernico, ferrite, or other magnetic materials having at least some permeability can be used.

The first magnetic piece 23 comprises a principal face portion 23*a* for absorbing an external magnetic field, a first arm 23*b* for leading the magnetic field absorbed by the principal face portion 23*a* near the right (the right side as seen from the screen side) electron beam (not shown), that is, the electron beam that passes through the opening 22 of the shield cup 17, a first correction magnetic field generating face 23*c* for causing a correction magnetic field to act on the right electron beam, a second arm 23*d* for leading the magnetic field absorbed by the principal face portion 23*a* near the left electron beam (not shown), that is, the electron beam that passes through the opening 20 of the shield cup 17, and a second correction magnetic field generating face 23*e* for causing a correction magnetic field to act on the left electron beam.

The second magnetic piece 24 has the same shape as the first magnetic piece 23 and comprises a principal face portion 24*a* for absorbing an external magnetic field, a first arm 24*b* for leading the magnetic field absorbed by the principal face portion 24*a* near the left electron beam (not shown), a first correction magnetic field generating face 24*c* for causing a correction magnetic field to act on the left electron beam, a second arm 24*d* for leading the magnetic field absorbed by the principal face portion 24*a* near the right electron beam (not shown), and a second correction magnetic field generating face 24*e* for causing a correction magnetic field to act on the right electron beam.

The members used for the first and second magnetic pieces 23 and 24 can be the same. Each of the magnetic pieces has a symmetrical shape with respect to the axis that crosses the tube axis of the color cathode ray tube and is perpendicular to the plane on which the electron beams are arranged in line. The first and second magnetic pieces 23 and 24 are located symmetrically with respect to the plane on which the electron beams are arranged in line.

The third magnetic piece 25 comprises a principal face portion 25*a* for absorbing an external magnetic field, a first correction magnetic field generating face 25*b* for causing the magnetic field absorbed by the principal face portion 25*a* to act on the right electron beam, and a second correction magnetic field generating face 25*c* for causing the magnetic field absorbed by the principal face portion 25*a* to act on the left electron beam. The first correction magnetic field generating face 25*b* is opposed to the first correction magnetic field generating face 23*c* of the first magnetic piece. The second correction magnetic field generating face 25*c* is opposed to the second correction magnetic field generating face 23*e* of the first magnetic piece.

The fourth magnetic piece 26 comprises a principal face portion 26*a* for absorbing an external magnetic field, a first correction magnetic field generating face 26*b* for causing the magnetic field absorbed by the principal face portion 26*a* to act on the left electron beam, and a second correction magnetic field generating face 26*c* for causing the magnetic field absorbed by the principal face portion 26*a* to act on the right electron beam. The first correction magnetic field generating face 26*b* is opposed to the first correction magnetic field generating face 24*c* of the second magnetic piece. The second correction magnetic field generating face 26*c* is opposed to the second correction magnetic field generating face 24*e* of the second magnetic piece.

The members used for the third and fourth magnetic pieces 25 and 26 can be identical. The magnetic pieces are located in rotational symmetry with respect to the tube axis of the color cathode ray tube.

The third and fourth magnetic pieces 25 and 26 are fixed in such a manner that the principal face portions 25*a* and 26*a* are in contact with the inner surface of the circumferential wall of the shield cup 17. The principal face portion 23*a* of the first magnetic piece 23 is fixed inside and in contact with the principal face portion 25*a* of the third magnetic piece 25. The principal face portion 24*a* of the second magnetic piece 24 is fixed inside and in contact with the principal face portion 26*a* of the fourth magnetic piece 26.

The position of the magnetic pieces can be controlled easily and the magnetic pieces can be fixed firmly by using the shape of the magnetic pieces and locating them as shown in FIG. 1.

Next, the operation of the color cathode ray tube apparatus in this embodiment will be described below.

Figure 4:
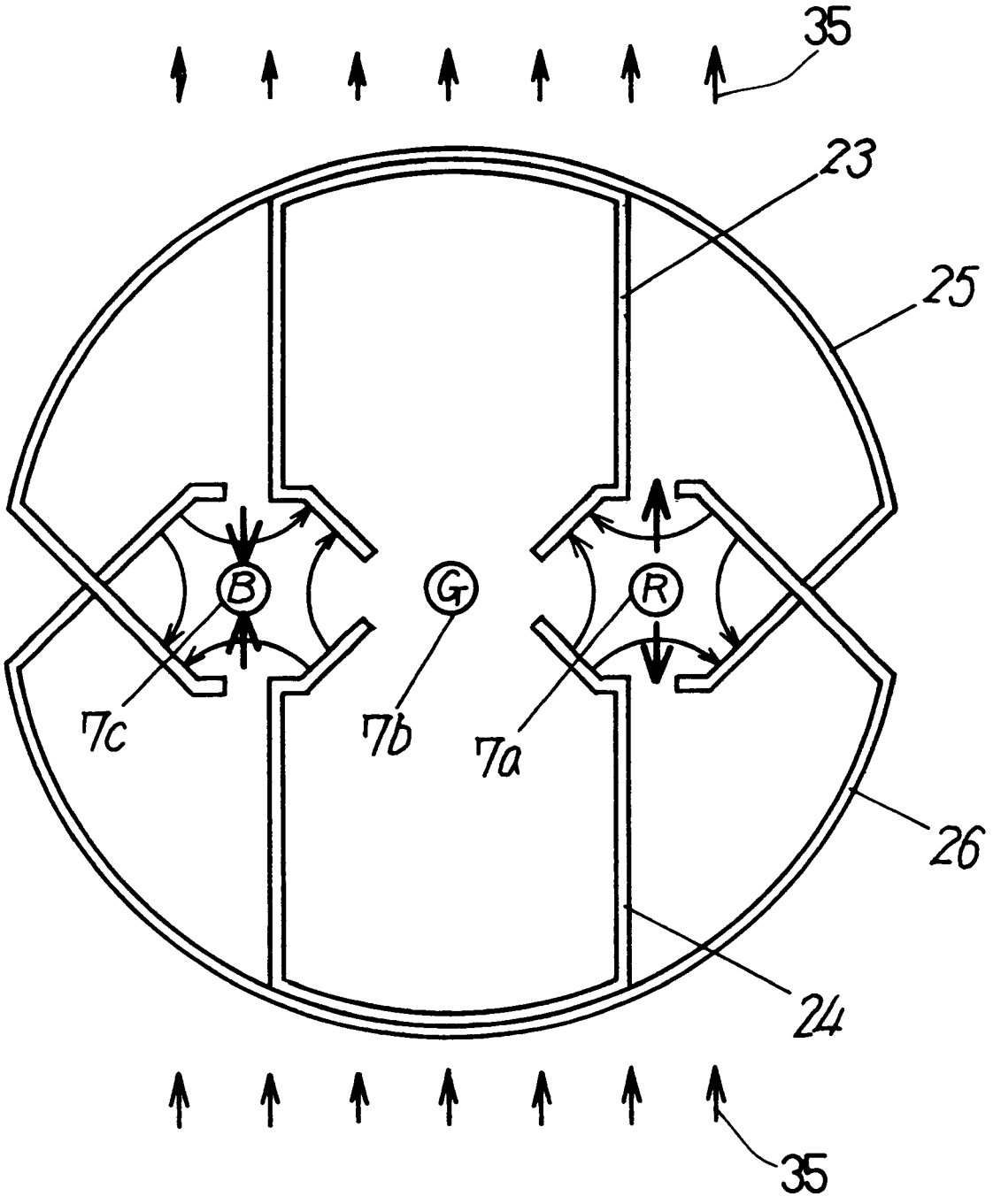
FIG. 4 shows the action of the correction system of the color cathode ray tube apparatus according to the first embodiment with respect to electron beams.

FIG. 4 shows the correction system of the color cathode ray tube apparatus in this embodiment as seen from the phosphor screen side.

In FIG. 4, arrows 35 represent a deflection magnetic field generated by the deflection yoke of the color cathode ray tube apparatus in this embodiment. In FIG. 4, the direction of the deflection magnetic field is upward, that is, the electron beams are deflected to the right side of the screen.

As can be seen from FIG. 4, a four-pole magnetic field that distorts the cross section of the electron beam to be vertically long is generated for the right electron beam 7*a* (R beam), and a four-pole magnetic field that distorts the cross section of the electron beam to be horizontally long is generated for the left electron beam 7*c* (B beam).

Figure 8:
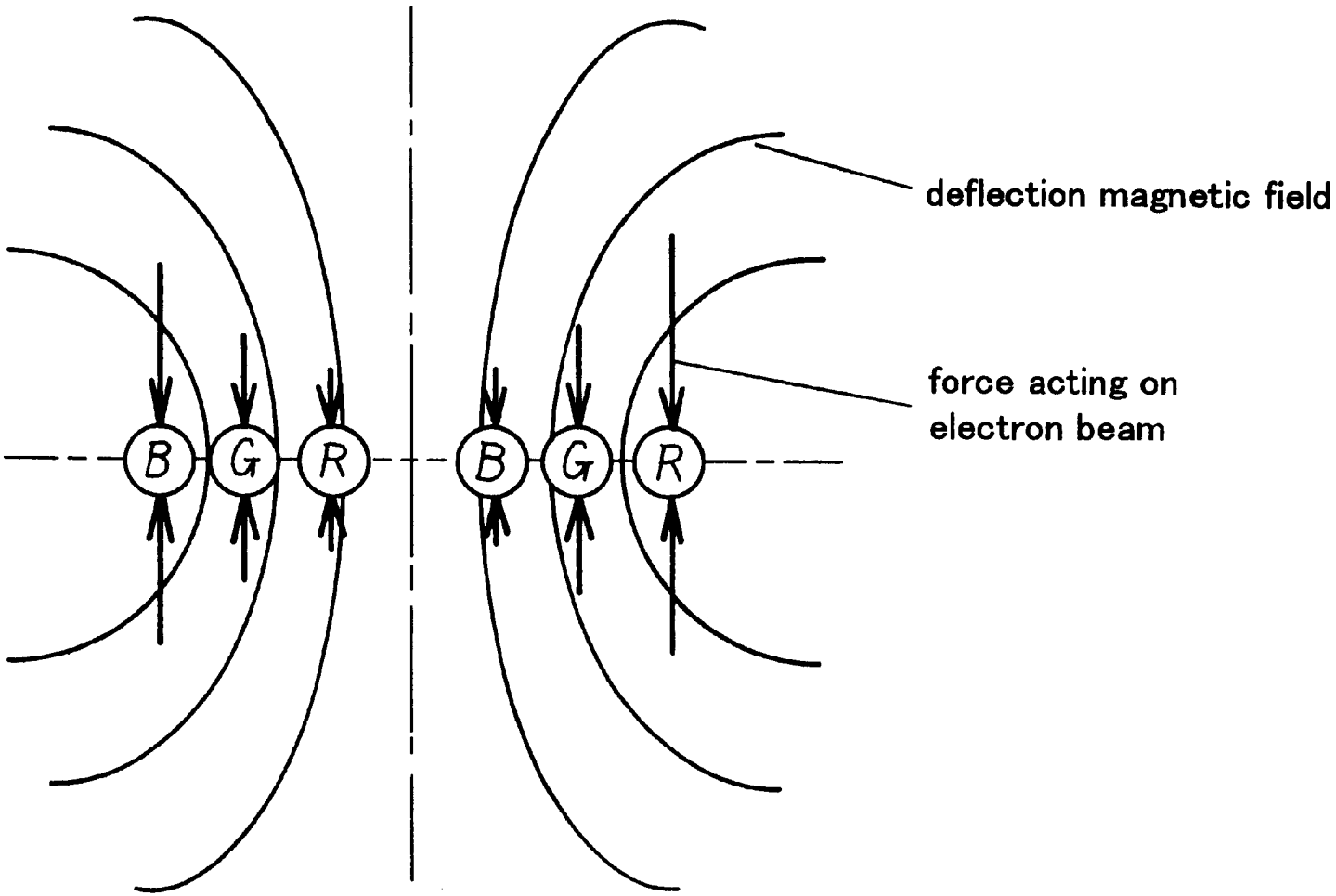
FIG. 8 shows forces acting on electron beams in a self-convergence magnetic field.

The force for correcting the cross-sectional shape of the electron beams depends on the strength of the deflection magnetic field absorbed by the principal face portions 23*a*, 24*a*, 25*a* and 26*a* of the magnetic pieces 23, 24, 25 and 26, that is, the degree of deflection. Thus, the correction system of the color cathode ray tube apparatus according to the embodiment of the present invention can effectively correct the difference in astigmatism amount among the electron beams caused by the deflection magnetic field as shown in FIG. 8.

Figure 5:
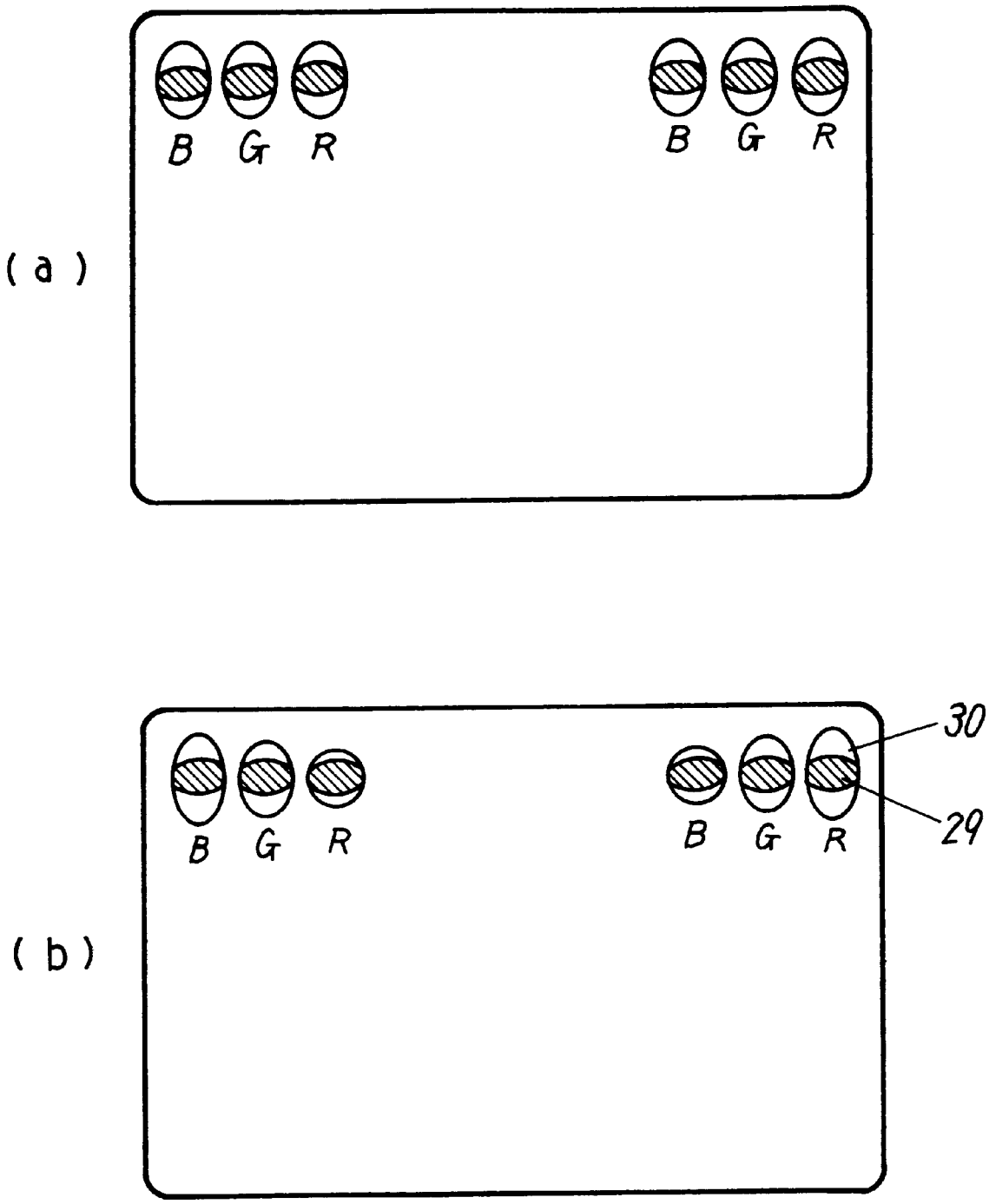
FIGS. 5(*a*) and (*b*) are schematic views of the shape of beam spots on the phosphor screen of a color cathode ray tube apparatus.

In the color cathode ray tube apparatus according to the embodiment of the present invention, the difference in the shape of electron beam spots on the phosphor screen disappears near the corners of the screen as shown in FIG. 5(*a*). In a conventional color cathode ray tube apparatus, electron beams in the outer regions in the deflection directions are subjected to an intense astigmatism, so that the spots of such electron beams on the phosphor screen have a core portion 29 whose shape is elongated horizontally and large haze portions 30 extending upward and downward from the core portion 29 as shown in FIG. 5(*b*).

As described above, in the color cathode ray tube apparatus according to this embodiment, a correction magnetic field having a strength according to the difference in astigmatism amount acts on the electron beams, and the difference in astigmatism amount among the electron beams disappears over the whole phosphor screen. Therefore, display images can be obtained with a high resolution over the whole phosphor screen.

In the color cathode ray tube apparatus according to the first embodiment of the present invention, the most efficient correction can be conducted by locating the magnetic pieces 23, 24, 25 and 26 in such a manner that all of their correction magnetic field generating faces cross the axis in the direction of the in-line arrangement of the electron beams at an angle of 45 degrees so that the correction magnetic field generating faces are opposed to each other.

However, the color cathode ray tube apparatus according to this embodiment is not limited to this. As long as the cross-sectional shape of the electron beams can be corrected by the correction magnetic field, the correction magnetic field generating faces sandwiching an electron beam may be opposed to each other partly, or the angle formed by the correction magnetic field generating faces and the axis in the in-line arrangement direction may be other than 45 degrees.

In addition, the size of the principal face portion and correction magnetic field generating face of each magnetic piece should be selected properly according to the strength of the magnetic field to act on the electron beams, and the like, and all portions of each magnetic piece need not have the same width and thickness.

Second Embodiment

A color cathode ray tube apparatus according to a second embodiment of the present invention is the same as that of the first embodiment except that the means for correcting the astigmatism amount of the electron beams is different.

Figure 6:
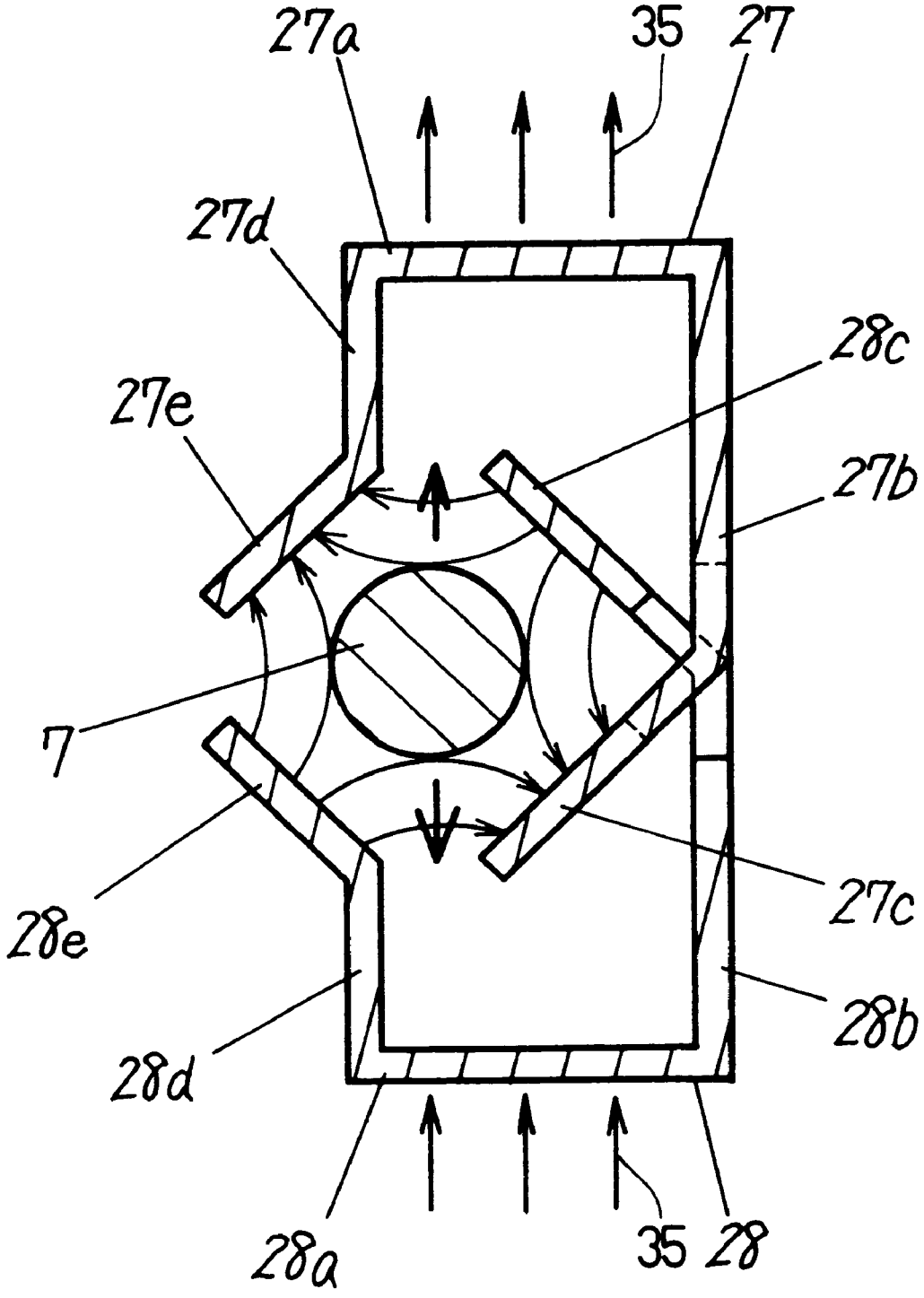
FIG. 6 is a cross-sectional view of the correction system of a color cathode ray tube apparatus according to a second embodiment of the present invention.

FIG. 6 is a cross-sectional view of the correction system of the color cathode ray tube apparatus according to the second embodiment of the present invention. The correction system causes a correction magnetic field to act on one electron beam.

The correction system comprises a first magnetic piece 27 and a second magnetic piece 28.

The first magnetic piece 27 comprises a principal face portion 27*a* for absorbing an external magnetic field, a first arm 27*b* for leading the magnetic field absorbed by the principal face portion 27*a* near an electron beam 7, a first correction magnetic field generating face 27*c* provided at the tip of the first arm 27*b* for causing a correction magnetic field to act on the electron beam 7, a second correction magnetic field generating face 27*e* opposed to the first correction magnetic field generating face 27*c*, and a second arm 27*d* for leading the magnetic field absorbed by the principal face portion 27*a* to the second correction magnetic field generating face 27*e*.

The second magnetic piece 28 has a shape substantially symmetrical with respect to the first magnetic piece 27 and comprises a principal face portion 28*a* for absorbing an external magnetic field, a first arm 28*b* for leading the magnetic field absorbed by the principal face portion 28*a* near the electron beam 7, a first correction magnetic field generating face 28*c* provided at the tip of the first arm 28*b* for causing a correction magnetic field to act on the electron beam 7, a second correction magnetic field generating face 28*e* opposed to the first correction magnetic field generating face 28*c*, and a second arm 28*d* for leading the magnetic field absorbed by the principal face portion 28*a* to the second correction magnetic field generating face 28*e*.

The first arm 27*b* of the first magnetic piece 27 and the first arm 28*b* of the second magnetic piece 28 cross each other without contact.

Each of these magnetic pieces is made by working a magnetic ribbon of $\mu$-metal (FeNi alloy) or the like having a thickness of 0.25 mm and a width of 5.0 mm.

When a deflection magnetic field 35 indicated by black arrows in FIG. 6 acts on the correction system of the color cathode ray tube apparatus according to this embodiment, the cross-sectional shape of the electron beam 7 is distorted to be vertically long. Thus, the difference in astigmatism amount among the electron beams caused by the deflection magnetic field can be corrected effectively and reliably as in the first embodiment by locating the correction system as shown in FIG. 6 in such a manner that the correction system acts on the right electron beam and by locating a correction system that generates an opposite correction magnetic field, for example, a correction system in which the magnetic pieces 27 and 28 in FIG. 6 are located symmetrically with respect to the axis perpendicular to the electron beam arrangement direction, in such a manner that the correction system acts on the left electron beam.

In the correction system according to the second embodiment of the present invention, the most efficient correction can be conducted by locating the magnetic pieces 27 and 28 in such a manner that all of their correction magnetic field generating faces cross the axis in the direction of the in-line arrangement of the electron beams at an angle of 45 degrees so that the correction magnetic field generating faces are opposed to each other.

The correction system according to the second embodiment can be located in the shield cup of the electron gun or in any of the electrodes between the triode region and the shield cup because the correction system can be made relatively compact.

In the magnetic pieces 27 and 28 of the color cathode ray tube apparatus according to the second embodiment of the present invention, as long as the cross-sectional shape of the electron beams can be corrected by the correction magnetic field, the correction magnetic field generating faces sandwiching an electron beam may be opposed to each other partly, or the angle formed by the correction magnetic field generating faces and the axis in the in-line arrangement direction may be other than 45 degrees, as in the first embodiment. In addition, the size of the principal face portion and correction magnetic field generating face of each magnetic piece should be selected properly according to the strength of the magnetic field to act on the electron beam, and the like, and all portions of each magnetic piece need not have the same width and thickness.

In the above embodiments, the correction system of the present invention for correcting the difference in astigmatism amount among the three electron beams is applied to the color cathode ray tube apparatus comprising the correction system for correcting the astigmatism of the three electron beams simultaneously by using a quadrupole electron lens, which increases the strength of the voltage applied according to the deflection amount, between the first focusing electrode 14 and second focusing electrode 15 of the in-line type electron gun (see FIG. 7). However, the color cathode ray tube apparatus of the present invention is not limited to this. The correction system of the present invention can be applied to a color cathode ray tube apparatus using a simple voltage application method in which a dynamic voltage is applied only to the second focusing electrode and the first focusing electrode is connected to the second focusing electrode through a resistor. Also, the correction system can be applied to a color cathode ray tube apparatus comprising two or more quadrupole electron lenses.

In addition, it is apparent that the difference in astigmatism amount among the three electrode beams can be corrected by applying the present invention to an in-line type electron gun that does not have an astigmatism correcting means acting on three electron beams in common. In this case, the circuit configuration of a television set or the like using the color cathode ray tube apparatus can be simplified because the in-line type electron gun does not require an electrode for correcting the astigmatism of the electron beams.

While only the means for correcting the difference in astigmatism amount among the three electron beams by utilizing the magnetic field of the deflection yoke is described above, the present invention is not limited to this. A magnetic field whose strength varies in synchronization with the deflection magnetic field, for example, a magnetic field generated by an auxiliary coil connected in series or parallel with the horizontal deflection coil, can be used. In this case, the correction amount can be optimized because the absolute value of the strength of the magnetic field can be set freely while the fluctuation of the strength of the magnetic field is synchronized with the deflection magnetic field.

While the means for correcting the difference in astigmatism amount among the electron beams using the external magnetic field is described as the embodiments of the present invention, the present invention is not limited to this. The difference in astigmatism amount among the electron beams can be corrected with an electron lens obtained by locating the quadrupole electron lens producing means of the prior art in such a manner that it acts separately on the right and left electron beams. Thus, a color cathode ray tube apparatus that can display images with a high resolution over the whole phosphor screen can be implemented.

As described above, the color cathode ray tube apparatus of the present invention can correct the difference in the quadrupole astigmatism amount among the three electron beams, which is caused by the deflection magnetic field generated by the self-convergence type deflection yoke, over the whole phosphor screen. Therefore, images can be displayed with a high resolution over the whole phosphor screen especially in a color cathode ray tube apparatus having a large deflection angle and a short total length or a color cathode ray tube apparatus having a substantially flat phosphor screen.

The invention may be embodied in other forms without departing from the spirit or essential characteristics thereof. The embodiments disclosed in this application are to be considered in all respects as illustrative and not limitative, the scope of the invention is indicated by the appended claims rather than by the foregoing description, and all changes which come within the meaning and range of equivalency of the claims are intended to be embraced therein.

What is claimed is:

1. A color cathode ray tube apparatus comprising:

a color cathode ray tube comprising an in-line type electron gun for emitting three electron beams;

a self-convergence type deflection yoke, wherein the electron gun comprises a correction system for correcting a difference in astigmatism amount among the three electron beams emitted from the electron gun;

wherein the color cathode ray tube allows horizontal and vertical forces to act on the electron beams on both sides among the three electron beams arranged in line, and the horizontal force acting on the electron beam on one side is prescribed to be opposite in direction to the horizontal force acting on the electron beam on the other side, and the vertical force acting on the electron beam on one side is prescribed to be opposite in direction to the vertical force acting on the electron beam on the other side, whereby the difference in astigmatism amount caused between the electron beams on both sides is corrected.

2. The color cathode ray tube apparatus according to claim 1, wherein the correction system causes a correction magnetic field to act on at least one outer electron beam of the three electron beams by using a deflection magnetic field generated by the deflection yoke or a magnetic field whose strength varies in synchronization with the deflection magnetic field, thereby changing a cross-sectional shape of the at least one outer electron beam.

3. The color cathode ray tube apparatus according to claim 1, wherein the correction system comprises magnetic pieces comprising a principal face portion for absorbing an external magnetic field, an arm for guiding the external magnetic field absorbed by the principal face portion near the electron beam, and a correction magnetic field generating face provided at a tip of the arm and facing the electron beam, the magnetic pieces being positioned so that the correction magnetic field generating faces sandwich at least one outer electron beam of the three electron beams.

4. The color cathode ray tube apparatus according to claim 1, wherein the in-line type electron gun further comprises a second correction system for correcting astigmatism of the three electron beams simultaneously.

* * * * *